US005080294A

United States Patent [19]

Dean

[11] Patent Number: 5,080,294

[45] Date of Patent: Jan. 14, 1992

[54] GYRATORY MANTLE LINER ASSEMBLY

[75] Inventor: Lance Dean, Elko, Nev.

[73] Assignee: Newmont Gold Company, Carlin, Nebr.

[21] Appl. No.: 579,557

[22] Filed: Sep. 11, 1990

[51] Int. Cl.[5] ..... B02C 2/00

[52] U.S. Cl. ..... 241/294; 241/207; 241/300

[58] Field of Search ..... 241/207-216, 241/294, 300, 295

[56] References Cited

U.S. PATENT DOCUMENTS

| | | | |
|---|---|---|---|
| 251,040 | 12/1881 | Gates | 241/294 |
| 2,441,205 | 5/1948 | Peterson | 241/300 |
| 2,721,036 | 10/1955 | Kueneman et al. | 241/300 X |
| 2,828,925 | 4/1958 | Rumpel | 241/300 X |
| 4,886,218 | 12/1989 | Bradley et al. | 241/300 X |

FOREIGN PATENT DOCUMENTS

| | | | |
|---|---|---|---|
| 144085 | 1/1962 | U.S.S.R. | 241/300 |

*Primary Examiner*—Mark Rosenbaum

*Attorney, Agent, or Firm*—Fred A. Keire; Mary Ann G. Mullen

[57] ABSTRACT

A gyratory mantle liner assembly for use in a gyratory cone crushing machine; each assembly includes a retaining ring formed from high density steel having a conical lip on the edge surface thereof, a conical shape upper liner having arcuate teeth and a bevelled lower-end surface on the arcuate teeth formed from mild steel, a plurality of lower liner segments having an upper arcuate tooth surface with a bevelled edge and a seat, and a retaining nut for tightening and holding in position the upper and lower liner segments. The lower liner segments defining the crushing surface are made from heat treated alloy material and are arranged in a ring fashion on the bell skirt without the need for adhesives.

19 Claims, 5 Drawing Sheets

GYRATORY MANTLE LINER ASSEMBLY

BACKGROUND OF THE INVENTION

1. Field of the Invention

This invention relates to a liner assembly for rock crushers; particularly, the invention relates to the multi-sectional mantle liner in a gyratory type crusher; more particularly, this invention relates to gyratory crusher which has sections of liner of different performance characteristics making the liner especially wear resistent, easily replaceable and of outstanding overall performance.

2. Description of the Prior Art

Gyratory type crushers are used in the mining industry for reducing ore to a predetermined size for further processing. The development of improved supports and drive mechanisms has allowed gyratory crushers to take over most large hard-ore and mineral-crushing applications and has made these an integral part of the mining industry. Typically, a gyratory crusher comprises a stationary conical bowl or mortar which opens upwardly and has an annular opening in its top to receive feed material. A conical mantle or pestle opening downwardly is disposed within the center of the larger bowl which is eccentrically oscillated for gyratory crushing movement with respect to the bowl. The conical angles of the mantle and bowl are such that the width of the passage decreases toward the bottom of the working faces and may be adjusted to define the smallest diameter of product ore. The oscillatory motion causes impact with some attrition as a piece of ore is caught between the working faces of the bowl and mantle. Furthermore, each bowl and mantle includes a liner assembly replaceably mounted on the working faces, and these liners define the actual crushing surface.

A substantial amount of prior art exists relating to gyratory mantle lining assemblies, however, none of it discloses the present invention or its advantages.

For example, U.S. Pat. No. 3,850,376 relates to a mantle for a gyratory crusher whereby the mantle lining has a concentric groove which supposedly permits the mantle lining to flow into this groove when crushing ore thereby reducing the bulging of the liner.

U.S. Pat. No. 3,834,633 relates to a mantle lining assembly for a gyratory crusher having a plurality of arcuate segments, arranged in a ring fashion on the backing plate, and secured thereto with a resilient adhesive such as polyurethane.

U.S. Pat. No. 3,406,917 and U.S. Reissue No. 26,923 relates to a lining ring assembly for gyratory type crushers having a plurality of segmented members which fit together with one another on the mounting ring to provide the desired grinding surface.

U.S. Pat. No. 3,064,909 relates to a protective ring for the locking nut which retains the mantle element on the central shaft assembly of the gyratory type crusher.

U.S. Pat. No. 2,913,189 relates to a mantle design for a gyratory crusher whereby the process of zincing is simplified. This zincing process, in conjunction with a liner backing design, supposedly keeps the mantle and liner tightly mounted as a single unit.

U.S. Pat. No. 1,423,792 relates to a mantle lining assembly for a gyratory crusher whereby the upper and lower mantle sections are held together by locking keys.

U.S. Pat. No. 1,154,100 relates to a mantle lining assembly for a gyratory crusher whereby the upper and lower mantle sections are locked together by an interlock design of the same.

U.S. Pat. No. 1,151,199 relates to a mantle assembly for a gyratory type crusher whereby the upper and lower mantle sections are locked together by a helical end surface design of the same.

U.S. Pat. No. 1,066,277 relates to a mantle assembly for a gyratory type crusher whereby the upper and lower mantle sections are locked together by an S-shaped end surface design of the same.

By far, the largest operating expense for a gyratory crusher unit is associated with relining. It is standard practice for the liner of a gyratory crusher mantle to be of one basic shape and of one type of material, as shown in FIG. 2 herein, illustrating the prior art. The crusher mantle assembly is a conical-shaped main shaft with upper and lower bearing surfaces, and a mantle liner piece secured by a retaining nut. The liner of the mantle is a metal sleeve or outer-skin which is replaceable. Typically, the liner has a fundamental shape of a hollow frusto-conical section opening downwardly which fits over the conical shaped main shaft. In order to secure the liner to the mantle, a retaining nut forces the liner downward onto the mantle thereby preventing axial movement of the liner relative to the mantle. The preferred lining material which is generally used is manganese steel which is soft until it becomes work-hardened. The work-hardening process occurs during the act of rock crushing which may develop a surface hardness up to approximately 600 Brinell Hardness Number.

However, single liners have several disadvantages, principally, their large size makes them extremely costly per ton of ore crushed. A further component of the cost is in the changing of the conical liner. It is labor-wise costly to change a single mantle liner because the main shaft must be completely removed from the gyratory crusher before a worn liner can be changed. As a consequence, in continuous ore crushing operations where machine down-time is critical, it is costly to have an inoperative, idle ore crusher.

Another disadvantage of the single liner is the problem of improper wear-in or work-hardening. This problem exists because different ore types do not properly work-harden a manganese steel liner to high surface hardness thereby resulting in less than optimum wear life, and increased crushing cost.

In an attempt to overcome the problems of these increased production costs and the problems of rapid liner wear associated with single mantle liners of the prior art, multi-sectional liners have been proposed. The prior art principally sought to overcome the manufacturing costs of construction by reducing the size of each liner section. Typically, the area of greatest stress in a gyratory crusher or the area where the greater part of mantle liner wear occurs is on the bottom or lower half of the liner. It is here that the mantle is subjected to the hardest crushing work and, thus, the greatest wear. Accordingly, as shown in FIG. 3 herein, illustrating another approach by the prior art, multi-sectional liners were developed so that only the worn lower half would need replacement, thereby reducing costs.

In the prior art, different materials have been proposed to solve the problem of this inadequate work-hardening of a liner by using hard metal alloys such as either martensitic white iron or martensitic steel. Metal alloy materials which are ideal from the standpoint of abrasion resistance, however, are difficult to use and manufacture. These alloys are more brittle and undergo significant dimensional change as these are heat treated during manufacture. Furthermore, an inherent risk in using large conical heat-treated alloy liners in ore crushing operations is the possibility of catastrophic failure which is caused by the brittle and crack-sensitive nature of these alloys. Unlike the concave liners of the bowl which are held in place by the geometry of their arched structure, the mantle liners are free to fall off once cracking is initiated thereby jamming the gyratory crusher.

The need to secure each liner to the mantle core in order to prevent the movement of the liner is a disadvantage of historically known multi-sectional mantle liner assemblies. The prior art principally sought to overcome these problems through the process of zincing, which involves pouring molten zinc into channels or grooves on the posterior surface of the mantle liner, thereby securing the liner to the main shaft. Although zinc has historically been used as a liner locking device that often is no longer the case. More recently NORDBACK TM type plastic compounds have been used as backing material. Once a liner is in place, as described for the zinc, the poured NORDBACK TM fills in all voids and provides a close form fitting backing. These materials serve two purposes: a) providing a close tolerance backing to prevent a liner from "rattling" and experiencing deformations; and b) serving as a barrier between the liner(s) and mainshaft which protects the expensive mainshaft dimensions from being eroded due to many minute liner movements during its useful life.

Another method for securing the liner sections, which interlocks the liner and mantle core, provides slots for insertion of a steel bar. This bar joins and locks both sections and, further, prevents axial movement of the mantle liner relative to the mantle core. Still another proposed method to interlock the liner sections is to have an interlocking posterior surface design and to use zincing to secure the same to the mantle core. However, this additional step of securing the liner to the mantle core requires additional time and increases labor costs for removal and affixing of the liner.

In general, the multi-sectional liner reduces the construction costs of each liner section and, also, extends the usable life of the upper liner. However, the entire main shaft still has to be removed and disassembled in order to replace a worn lower lining section. Therefore, the cost associated with removing and replacing the entire mantle core and the problems of affixation to prevent the axial movement of the sections still remain.

Another disadvantage of known mantle liner assemblies is that some liners must be machined to fit with certain mantle assembly parts. Such fitting requires that a close tolerance is machined into the liner to insure proper spacing for the above mentioned zincing and other attachments. Although some conventional liners have consisted of a support plate which can be made of mild steel thus increasing the ease of machining, the problems associated with this manufacturing step have still persisted. Furthermore, in the prior art, in liner assemblies where the support plate directly engages the mantle core having a wear surface (e.g., manganese steel) affixed thereto, machining of the support plate is needed for a proper fit and, as a result, increases labor and thus cost of the liner manufacture. Finally, in order to provide an effective fit between the support plate and a liner wear surface, an additional machining step may be needed.

Still further, it has been proposed in the prior art to use multi-sectional mantle liners comprised of numerous liner plates of highly abrasive resistant material arranged concentrically around the mantle forming a conical shaped surface. In this manner, the entire mantle liner is formed of these liner plates. However, these multi-sectional mantle liner plate assemblies must be constructed with an interlocking mantleliner design, which provides the interlocking of a liner with the mantle core or an adjacent liner plate or even a wear-ring. These limitations decrease the shapes and materials from which the liner plates can be made and, further, increase the costs of construction and maintenance replacement.

Yet another disadvantage of known multi-sectional mantle liner plate assemblies is the need to back each liner plate to the mantle by the conventional zincing processes. Even though these liner plate assemblies of the prior art reduce the labor costs to change the liner, the additional steps of securing each liner plate to the mantle core or to an adjacent liner or even a wear-ring have not eliminated the time or reduced the cost needed for affixation and removal of the liner. Therefore, the shortcomings associated with the step needed to adhere a number of liner plates to the core remain to increase the time and labor involved in replacing a multi-sectional mantle liner plate.

BRIEF DESCRIPTION OF THE INVENTION

The present invention provides a new and improved mantle liner assembly which combines single conical upper mantle liner with a lower mantle liner assembly which is composed of a number of lower mantle liner segments made from wear resistent material. These lower liner segments may, in one embodiment, be positioned without the need for backing adhesives for securing these liner segments to the mantle core. This combination provides for a more durable lining assembly in which individual worn lower liner segments may be removed from the mantle core or main shaft assembly without a complete removal of the main shaft. This ability to remove individual liner segments has the advantages of increasing ore crushing production time and decreasing the costs of the associated labor and machine down-time needed to change a worn lower liner segment. Furthermore, this combination provides for a multiple liner assembly wherein more wear-resistant materials may be used for the lower liner segments reducing the problems of improper work hardening and increasing the durability of the same.

The present invention also provides a gyratory mantle liner assembly in which individual lower liner segments are accurately mass-produced by standard foundry practice without the added machining step which is needed to form interlocking surfaces. In relying upon these standard foundry practices several advantages are provided. One advantage is in the unlimited possibilities for variation of the liner profile depending on the specific needs of each crushing operation. Another advantage is in using different alloys or metallurgical processes, such as heat treatment, for manufacture depending on the specific purpose of the ore crushing operation and ore type.

Furthermore, the present invention provides a multi-sectional liner assembly with an interlocking geometry design of the upper and lower liner sections whereby such design reduces the possibility that the lower liner segments, even if worn or cracked, will fall away from the main shaft assembly.

Still further, the present invention provides a multi-sectional liner assembly with the further advantage of reducing the steps needed to change a worn lower liner section thereby further reducing crusher operating costs.

Additionally, the present invention provides for a simplified liner design for a multi-sectional liner assembly.

Other features, benefits, and advantages according to the present invention will become apparent from the following detailed description of an illustrated embodiment shown in the accompanying drawings.

DETAILED DESCRIPTION OF THE DRAWINGS AND DESCRIPTION EMBODIMENT OF THE PRESENT INVENTION

Figure 1:
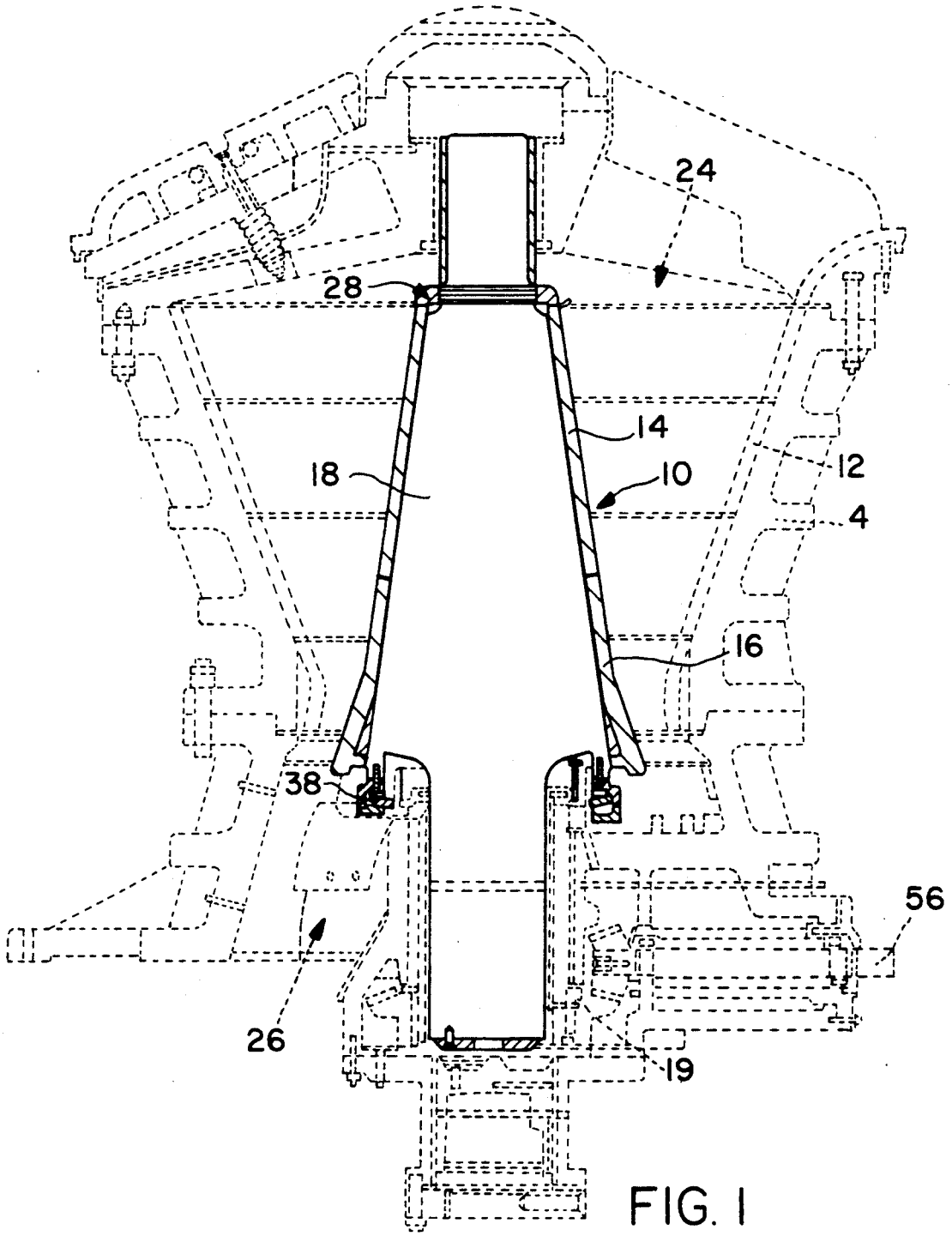
FIG. 1, is a partial front-end cross-sectional view of a conventional primary gyratory rock crusher.
Figure 3:
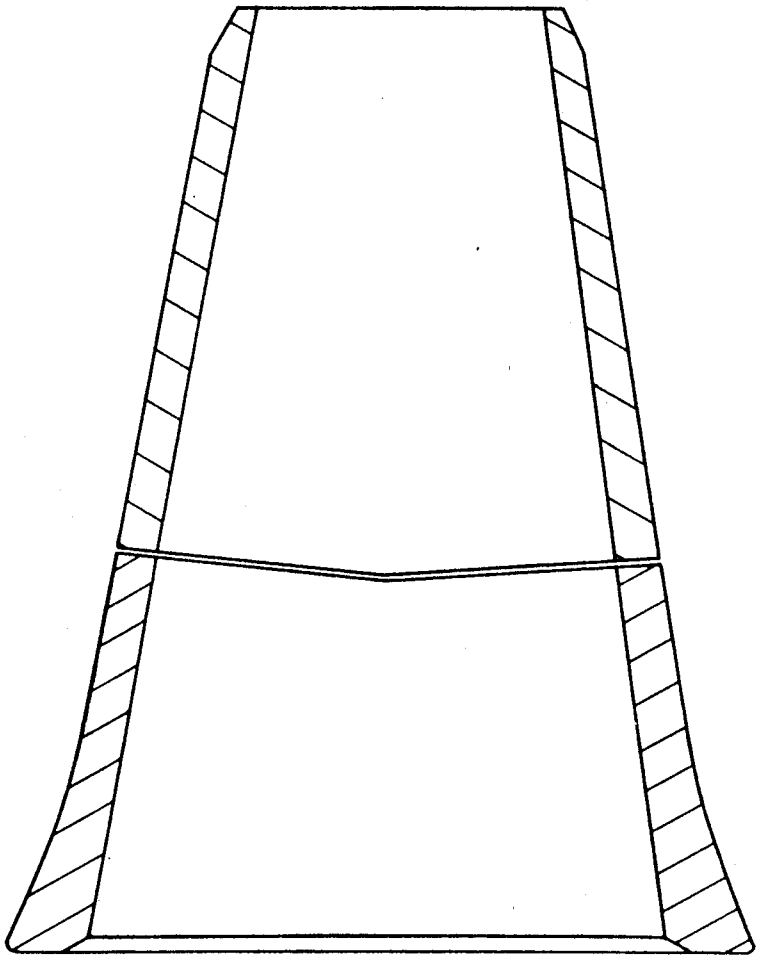
FIG. 3 (PRIOR ART)
FIG. 3, is a schematic cross-sectional view of a two-piece liner showing the upper and lower sections for a gyratory crusher mantle according to the prior art.
Figure 2:
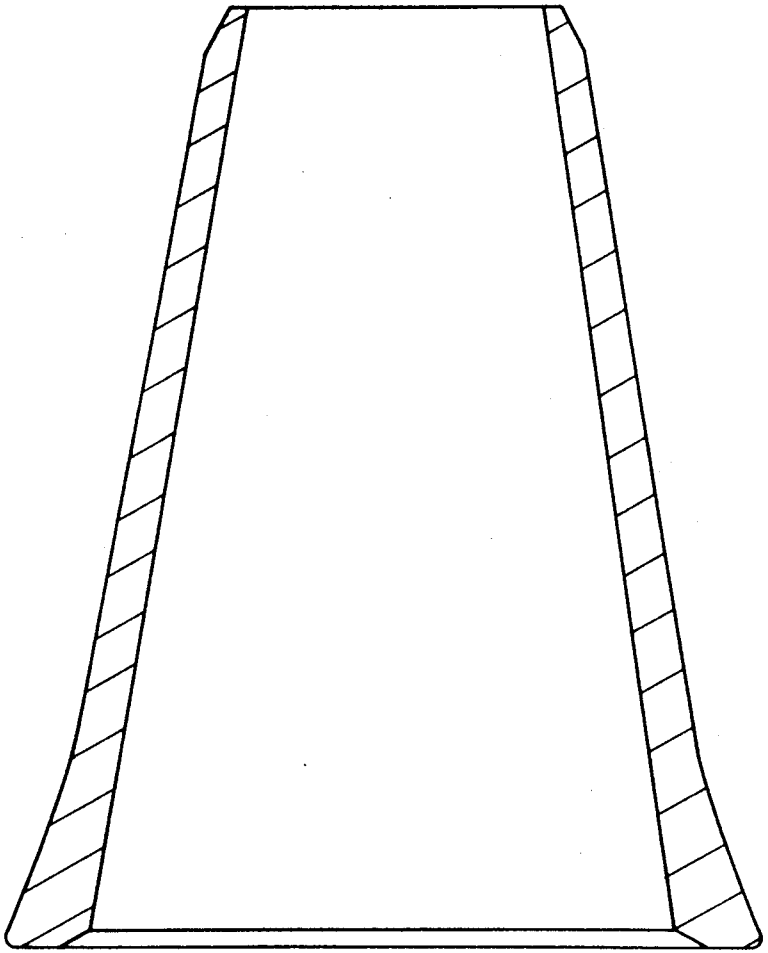
FIG. 2 (PRIOR ART)
FIG. 2, is a schematic cross-sectional view of a standard one-piece liner for a gyratory crusher mantle of the prior art.

The present invention provides an improved mantle liner for a gyratory crusher. Referring to FIG. 1, the gyratory crusher and mantle liner is shown generally at 1 and further assembly for a gyratory crusher is shown in cross-sectional view on the left and in partial front view on the right thereof.

The crusher generally consists of a shell 4, which forms a generally inverted truncated cone which is lined with wearable material forming a bowl or concave liner assembly 12. A main shaft 18 has a crushing head or mantle liner assembly shown generally as 10, comprised of an upper liner section 14 and a lower liner section shown generally as 16, both made of wearable material; a lower retaining ring 30; and a head nut or retaining nut 28.

The main shaft 18 rests on bearing plates within the lower eccentric. The main shaft 18 is caused to gyrate by a lower eccentric member 19 which is driven by pinion 56 to effect gyrating movement of the mantle liner assembly 10 with respect to the bowl liner assembly 12.

Figure 4:
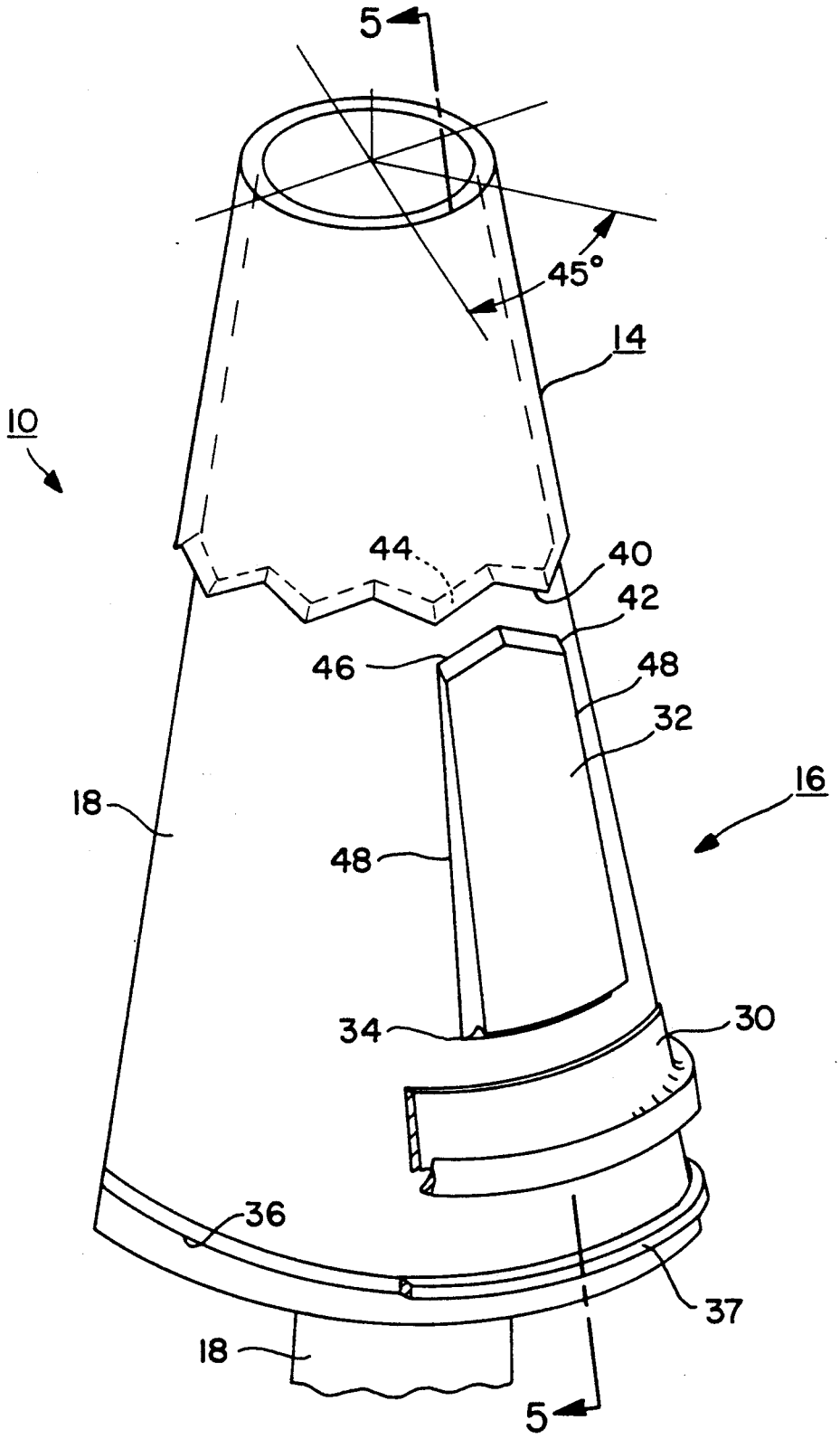
FIG. 4, is a schematic partially orthogonal view of the liner assembly for a gyratory crusher mantle according to an embodiment of the present invention.

The mantle liner assembly 10 is comprised of two sections: an upper liner section 14 and a lower liner section 16 which is formed from a plurality of lower liner segments 32, as further shown in FIG. 4.

It will be appreciated from the foregoing description that each liner of the bowl liner assembly 12 and mantle liner assembly 10 are removable to permit periodic replacement after these become worn.

The ore to be processed is fed through a feed inlet 24 at the top of the gyratory crusher and, typically, would first contact upper liner section 14 (shown in detail in FIG. 5) and progressively move down past the lower liner section 16 (shown in FIG. 5) as ore is being crushed. The gyratory movement of the rock crusher progressively crushes the rocks between the mantle liner assembly 10 and the bowl liner assembly 12 by the oscillatory movement generated by the eccentric gear 19 imparted to the main shaft 18. The rocks are thereby reduced in size to be subsequently dropped from the bowl and mantle liner assemblies 12 and 10 through product outlet 26 for further processing.

Figure 5:
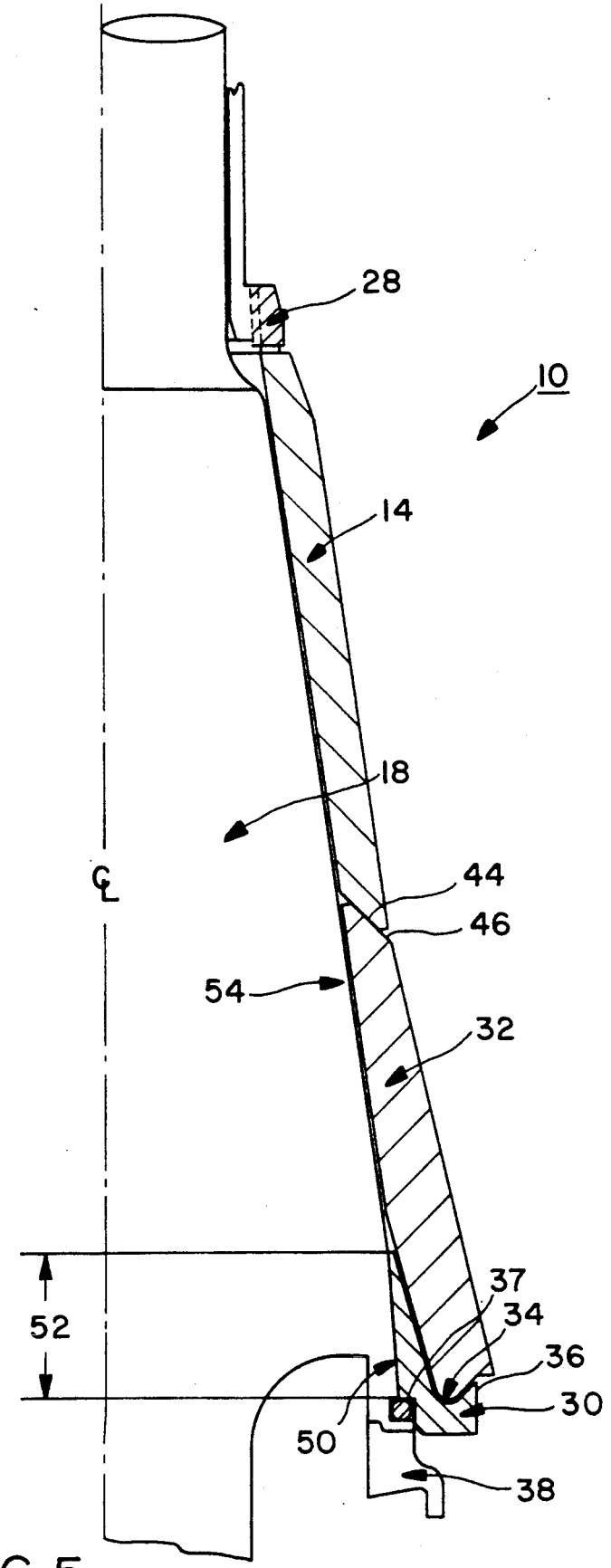
FIG. 5, taken along the lines 5—5 in FIG. 4, is a cross-sectional view of the mantle liner assembly of an embodiment of the present invention.

A perspective view of a gyratory mantle liner assembly according to an embodiment of the present invention is shown in FIGS. 4 and 5. FIG. 4, depicts a main shaft 18 having a bell on which a replaceable lower retaining ring 30 is affixed. The mantle liner assembly 10 is comprised of a conical shaped upper liner section 14 and a lower liner section 16 which is further comprised of lower liner segments 32. The lower liner segments 32 form a conical surface defining the lower liner section 16.

The frusto-conical section represented by upper liner section 14 opens downwardly and has arcuate teeth or notches 40 extending circumferentially therearound. The lower liner section 16 is comprised of eight lower liner segments 32 arranged circumferentially around the mantle liner assembly 10, having downwardly tapered side-ends 48, a lower-end surface defining a seat 34 and an upper-end surface 42 defining an arcuate tooth 42 with a bevelled tooth end 46. The upper liner section 14 and the lower liner section 16 may have from 6 to 10 segments. Preferably there may be eight lower liner segments 32.

In FIG. 5, the mantle core or liner assembly 10 comprises the lower retaining ring 30 having a conical lip 36 being affixed to the main shaft 18 by means of a groove and snap ring 37 to area 52 to ensure accurate axial location. The main shaft 18 further has a dust seal assembly 38 which limits and protects the gear and drive assemblies from the contamination by the dust or rocks generated by the crushing of ore. The upper liner section 14 and the multiple lower liner segments 32 are urged together by retaining nut 28 interdigitating each bevelled notched end 44 and each bevelled tooth end 46 of the arcuate teeth or notches 40 with the arcuate end tooth 42, respectively, and further forcing the seat 34 against the conical lip 36.

Referring to FIG. 5, the lower retaining ring 30 may be made from high tensile strength steel, e.g., heat treated alloy steel due to cost considerations, the more preferred material for the lower retaining ring is mild steel alloy. As mentioned above, the lower retaining ring 30 has a conical lip 36 which accepts the seat 34 of a lower liner segment 32 and supports the same. Moreover, the lower retaining ring 30 is semi-permanently affixed to the lower bell skirt area 52 by means of a snap ring 37. The retaining ring backing surface 50 may be formed by machining a conic surface thereto so that it conforms to the surface angle of the main shaft 18. Furthermore, one may heat the conical shaped lower retaining ring 30 making it expand, place it onto main shaft 18, and, as it cools, the contraction more permanently secures the lower retaining ring 30 thereon.

Figure 6A:
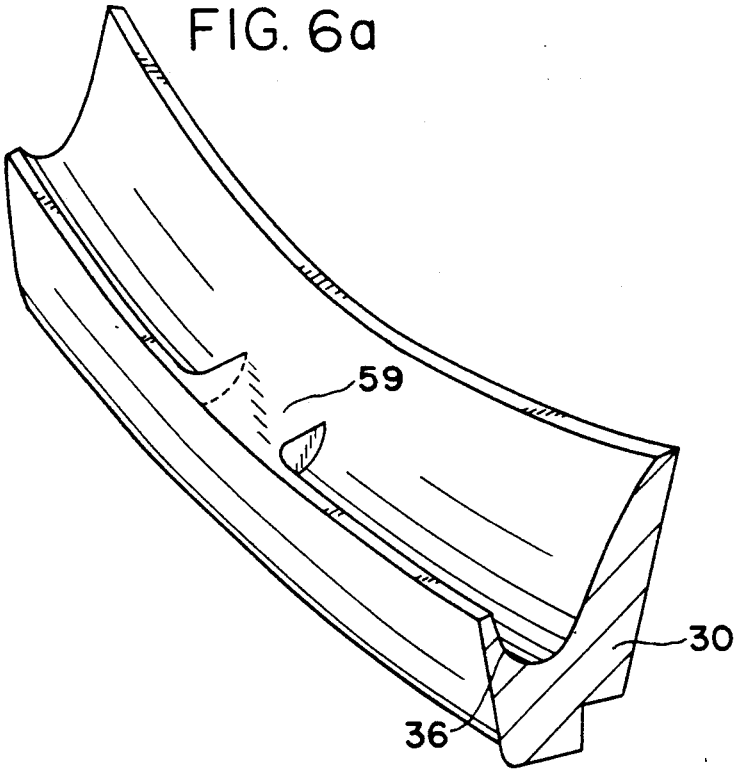
FIGS. 6*a* and 6*b* are schematic views of an interlocking design of an alternative embodiment of the present invention.
Figure 6B:
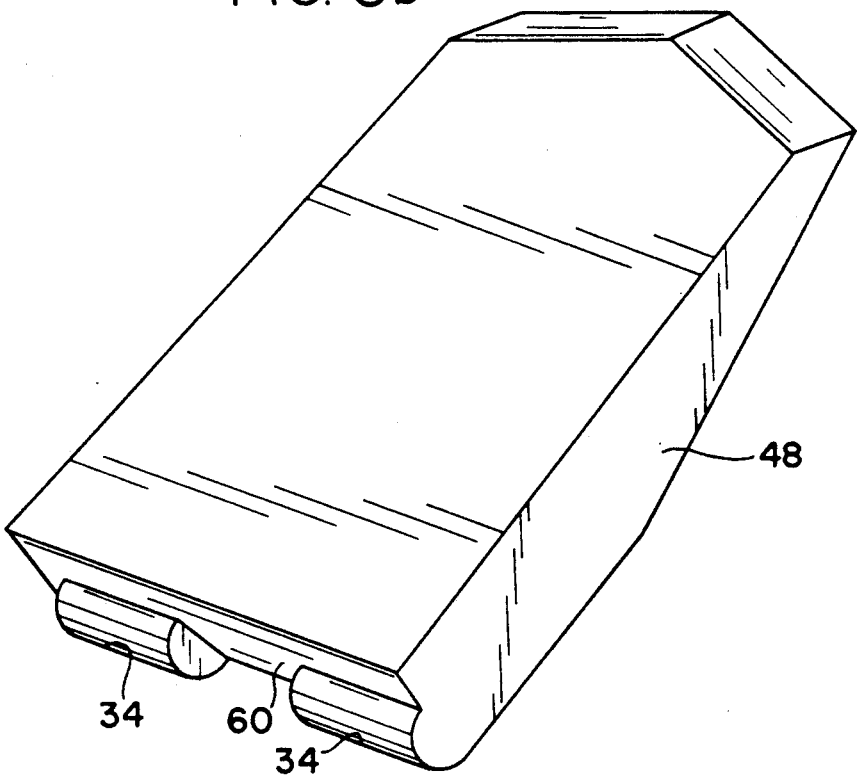

In an alternate embodiment of the present invention, referring now to FIGS. 6*a* and 6*b*, the lower retaining ring 30 having a conical lip 36 extending around the edge surface thereof, may incorporate further a raised portion 59 defining a lock, and the lower liner segments 32 may further have defined voids 60 in the seat portion 34 for interlocking with the conical lip 36 and for accepting the raised portion or lock 58, of the retaining ring 30.

Referring again to FIGS. 4 and 5, the upper liner section 14 is conically shaped opening downwardly and has concentric arcuate teeth or notches 40 and a bevelled notched end 44 of the same. The upper liner section 14 is made from a softer material than the lower liners segments, e.g., manganese steel. The arcuate teeth 40 have a bevelled notched end 44. The bevelled notched end 44 may be made in a conventional method, e.g., by standard foundry practices when making or casting the upper liner sections and no machining of these bevelled surfaces is required. Furthermore, by using the method of the present invention, the usable life of the upper liner section 14 may be extended between two to five times longer than a single liner of the prior art.

Referring to FIG. 4, each of the lower liner segments 32 may be concentrically arranged around the main shaft 18 to form a conic surface thereby defining the lower liner section 16. Each lower liner segment 32 has a seat 34 on the lower-end surface, tapered side-ends 48 downwardly tapered on the side-end surfaces, and arcuate tooth 42 having a bevelled tooth end 46 defined on the upper-end surface. The lower liner segment 32 has a backing surface 54, shown in FIG. 5, which forms an integral fit between each of the lower liner segments 32 and the main shaft 18. Each of the lower liner segments 32 is made from highly wear resistent material, e.g., heat treated metal alloys. No adhesives are needed to adhere the backing surface 54 of a lower liner segment 32 to the main shaft 18, as discussed below, because of the structures built into or incorporated in the mantle liner assembly 10.

Each of the lower liner segments 32 is held in place, that is against the main shaft 18 by the inward force generated by the bevelled edges of the bevelled notched end 44 and tooth end 46, and the downward force existed by the combination of the retaining nut 28 forcing the upper liner 14 section against a lower liner segment 32 against the lower retaining ring 30, as discussed below.

The mantle liner assembly 10 is held together by, among other things, a retaining nut 28 threaded on main shaft 18. The retaining nut 28 provides a downward pressure, forcing the upper liner section 14 and the lower liner section 16 made up of lower liner segments 32 together interdigitating the same between the stationary lower retaining ring 30 and the retaining nut 28.

The arcuate interface formed by the interdigitization of arcuate notches 40 and each arcuate end tooth is unique. The bevelled tooth end 46 and the bevelled notched end 44 cooperate when the retaining nut 28 is tightened to form an inward force which forces lower liner segments 32 and the backing surface 54 against the main shaft 18. The bevelled notched end 44 of arcuate notches 40 positions both vertically and laterally the lower liner segment 32 insuring both the accurate and vertical placement thereof. These forces are great enough so that no adhesives or zincing processes are needed to adhere the backing surface 54 of a lower liner segment 32 to the main shaft 18 to prevent lateral or axial movement of the lower liner segments 32. The downward tightening of the retaining nut 28 also exerts a downward or vertical force, centered at the inverted-V formed by the arcuate notch 40 and the arcuate tooth 42 but applied uniformly along the entire upper-end surface thereon, of an arcuate notch 40. Thus projecting a downward force upon the arcuate end tooth 42 at the interface of the bevelled notched end 44 and bevelled tooth end 46, a highly rigid, positive and outstanding securement of the liner is obtained. The downward force is equal and opposite between the retaining nut 28 and the lower retaining ring 30 (the last being semi-permanently affixed). The tightening force of the retaining nut also contributes and creates an inward force at the interface of the bevelled notched end 44 and the bevelled tooth end 46 forcing the backing surface 54 of a lower liner segment 32 against the main shaft 18 and positioning the same.

The upper liner section 14, made of a softer steel, i e., manganese steel, will have a wear-in or work-hardening period of a sufficient duration to harden the crushing surface of the upper liner section 14. During this period of time, the interdigitating interface between the arcuate notches 40 and arcuate tooth 42 will work harden surface 44 forming a still greater wear resistance to further extend the lift of upper liner section 14 the above description for its accuracy.

The mantle liner assembly 10 may be easily assembled and disassembled. In assembling the mantle liner assembly 10, having the lower retaining ring 30 semi-permanently affixed, each lower liner segment 32 is arranged around the lower retaining ring 30 by placing each seat 34 of each lower liner segment 32 into the conical lip 36. Each lower liner segment 32 thus placed may then rest against the downwardly tapered conical surface of the main shaft 18 forming the conical surface of the lower liner section 16. The upper liner section 14 is then placed over the main shaft 18 interdigitating the surfaces of the bevelled notched end 44 and tooth end 46 of the upper and lower liner sections 14 and 16, respectively. The retaining nut 28 is placed onto the main shaft 18 and tightened which forces each arcuate notch 40 and tooth 42 against each other forming a seal thereto. The seal vertically holds the upper and lower liner sections 14 and 16, respectively, in position as well as axially positions and holds the entire mantle liner assembly 10.

The upper liner segment 14 and lower liner section 16 formed of lower liner segments 32 may be made in varying length proportions as required, depending upon the needs of particular ore crushing applications.

In assembling the mantle liner assembly 10, only three steps are required: the arrangement of the lower liner segments 32 forming the lower liner section 16, the placement of the upper liner section 14 onto the bell skirt 20 of the main shaft 18 and the tightening of the retaining nut 28. Disassembly requires the above steps in reverse order.

The replacement of an individual worn or broken lower liner segment 32 is simplified in this embodiment of the present invention. Furthermore, the entire main shaft 18 and mantle liner assembly 10 does not need to be entirely removed to replace worn lower liner segments 32. In replacing worn liner segment 32, the retaining nut 28 is loosened, and upper liner section 14 is raised and held in place while each individual worn lower liner segments 32 is removed and replaced, and the retaining nut 28 is then tightened. The procedure is further simplified in that the tapered side-ends 48 of each lower liner segment 32 do not have to be attached or fitted together. Furthermore, the step of adhering each lower liner segment 32 to the main shaft with adhesive or zincing may not need to be performed. The main shaft 18 is then repositioned and crushing continued thereby saving much time, labor and thus reducing costs.

Although a preferred embodiment of the present invention has been described in detail herein, it is to be understood that this invention is not limited to that precise embodiment, and that many modifications and variations may be affected by one skilled in the art without departing from the invention as defined by the appended claims.

I claim:

1. A mantle liner assembly for use in a gyratory crusher comprising, ring means secured to a mainshaft;

segmented liner means including a seat for interlocking with said ring means, a backing surface between said mainshaft and said segmented liner means, an arcuate tooth on an upper-end surface, and said arcuate tooth including a segment-bevelled-end surface;

upper liner means including arcuate teeth forming a lower-end surface, said arcuate teeth including a bevelled-end surface for interdigitating said segmented liner means; and means for interdigitating said segmented liner means nd said upper liner means.

2. A mantle liner assembly is set forth in claim 1, wherein said ring means is composed of metal selected from the group consisting of hard metal alloy and mild steel.

3. A mantle liner assembly as set forth in claim 1, wherein said segmented liner means is made of wear resistant material.

4. A mantle liner assembly as set forth in claim 1, wherein said upper liner means is made of a less wear resistant material than said segmented liner means.

5. A mantle liner assembly as set forth in claim 1, wherein the interface formed by interdigitating each of said arcuate tooth of the segmented liner means and said arcuate teeth of said upper liner means vertically and axially position said segmented liner means holding each segmented liner means to said bell skirt.

6. A mantle liner assembly for use in a gyratory crusher comprising a retaining means secured to a mainshaft, said retaining means extending around an edge of said mainshaft;

a conical upper liner including a plurality of arcuate teeth at bottom thereof, said arcuate teeth including a bevelled lower-end surface sloping downwardly ad outwardly from an interior surface for said upper liner to an exterior surface for said upper liner;

a plurality of lower liner segments, each of said lower liner segments including a lower-end surface defining a seat for interlocking with said retaining means, each of said lower liner segments including an interior surface between said lower liner segments and said mainshaft, each of said lower liner segments having an upper-end surface defining an arcuate tooth, said arcuate tooth including a bevelled edge sloping downwardly from said interior surface to said exterior surface; and a retaining device for holding in position on said mainshaft said upper liner and each of said lower liner segments.

7. A mantle liner assembly as set forth in claim 6, wherein each of said lower liner segment is made from alloy material including heat treatable alloy materials.

8. A mantle liner assembly as set forth in claim 6, wherein each of said lower liner segments is secured through a force exerted by said retaining device acting through said upper liner and said retaining device.

9. A mantle liner assembly as set forth in claim 6, wherein each of said lower liner segments defines an arc of approximately 45° forming a conical surface comprised of eight lower liner segments.

10. A mantle liner assembly as set forth in claim 6, wherein said upper liner is made form a softer metal than said lower liner segments including manganese steel.

11. A mantle liner assembly as set forth in claim 6, wherein said retaining means is composed of metal selected from the group consisting of hard metal alloy and mild steel.

12. A mantle liner assembly as set forth in claim 6, wherein said retaining means is a ring semi-permanently secured to said mainshaft.

13. A mantle liner assembly for use in a gyratory crusher comprising a retaining means secured to a mainshaft, said retaining means extending around an edge surface thereof and including a raised portion;

a conical upper liner including a plurality of arcuate teeth at bottom thereof, said arcuate teeth including a bevelled lower-end surface sloping downwardly and outwardly from an interior surface for said upper liner to an exterior surface for said upper liner;

a plurality of lower liner segments, each of said lower liner segments including a lower-end surface defining a seat and a void for interlocking with said retaining means, each of said lower liner segments including a inner surface between said lower liner segments and said mainshaft, each of said lower liner segments having an upper-end surface defining an arcuate tooth, said arcuate tooth including a bevelled edge sloping downwardly from said interior surface to said exterior surface; and a retaining device for holding in position on said bell skirt said upper liner and each of said lower liner segments.

14. A mantle liner assembly as set forth in claim 13 wherein each of said lower liner segments is made from a heat treatable alloy materials.

15. A mantle liner assembly as set forth in claim 13, wherein each of said lower liner segments is secured through a force exerted by said retaining device acting through said upper liner and said retaining means.

16. A mantle liner assembly as set forth in claim 13, wherein each of said lower liner segments defines an arc of approximately 45° forming a conical surface comprised of eight lower liner segments.

17. A mantle liner assembly as set forth in claim 13, wherein said upper liner being made from a softer metal than said lower liner segments including maganese steel.

18. A mantle liner assembly as set forth in claim 13, wherein said retaining means is of a metal selected from the group consisting of hard metal alloy and mild steel.

19. A mantle liner assembly as set forth in claim 13, wherein said retaining means is a ring semi-permanently secured to said mainshaft.

* * * * *

UNITED STATES PATENT AND TRADEMARK OFFICE

CERTIFICATE OF CORRECTION

PATENT NO. : 5,080,294

DATED : January 14, 1992

INVENTOR(S) : Lance Dean

It is certified that error appears in the above-identified patent and that said Letters Patent is hereby corrected as shown below:

Title page, item [57], col. 2,
In the abstract, last line, change "bell skirt" to --mainshaft--.

Column 6, lines 30-31, delete "The upper liner section 14 and".

Column 6, line 31, change "the" to --The--.

Column 8, line 22, change "lift" to --life--.

Column 8, lines 51-52, delete "the bell skirt 20 of".

Column 9, line 27, change "nd" to --and--.

Column 10, lines 44-45, delete "bell skirt" and replace with --mainshaft--.

Signed and Sealed this

Nineteenth Day of October, 1993

*Attest:*

Bruce Lehman

BRUCE LEHMAN

*Attesting Officer*

*Commissioner of Patents and Trademarks*